United States Patent [19]

Tada

[11] Patent Number: 4,493,567

[45] Date of Patent: Jan. 15, 1985

[54] IMPACT DOT PRINTING HEAD

[75] Inventor: Ikuo Tada, Morioka, Japan

[73] Assignee: Alps Electric Co., Ltd., Tokyo, Japan

[21] Appl. No.: 323,032

[22] Filed: Nov. 19, 1981

[30] Foreign Application Priority Data

Nov. 19, 1980 [JP] Japan ..... 55-165507

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 4,037,704 7/1977 Golobay et al. ..... 400/124

4,156,960 6/1979 Ikeda ..... 400/124

4,273,039 6/1981 Luo et al. ..... 400/124 X 4,348,120 9/1982 Isobe et al. ..... 101/93.05 X 4,428,691 1/1984 Suzuki et al. ..... 400/124

*Primary Examiner*—Paul T. Sewell

*Attorney, Agent, or Firm*—Guy W. Shoup; Gerard F. Dunne

[57] ABSTRACT

A printing head of the type in which a printing operation is executed by releasing a permanent magnet, characterized in that the permanent magnet is made of a material of high energy product and is arranged in a central part of the printing head, so that the printing head is miniaturized.

4 Claims, 3 Drawing Figures

IMPACT DOT PRINTING HEAD

BACKGROUND OF THE INVENTION

The present invention relates to an impact dot printing head, and more particularly, to such a printing head of small size.

A known impact dot printing head is shown in FIG. 1. A ring-shaped permanent magnet 1 is assembled in the outer peripheral part of the printing head. A common lower yoke 2 is coupled with one pole side 1-*a* of the permanent magnet 1. A plurality of iron cores 4 having coils 3 wound therearound; extend upwardly from the lower yoke 2. A common upper yoke 5 is coupled with the other pole side 1-*b* of the permanent magnet 1. The upper yoke 5 is provided with openings 5-*a* in its positions opposing the iron cores 4. Armatures 7 fastened to an elastic member (leaf spring) 6 are fitted in the respective openings 5-*a* in a rockable fashion, with clearances therebetween.

Printing wires 8 . . . are fixed to the fore end parts of the respective members 6. The base end parts of the elastic members 6 are fixed between the upper yoke 5 and a case 9 with screws or the like. In the illustrated state, the armatures 7 are attracted to the respective iron cores 4 against the elastic members 6 by the permanent magnet 1. By energizing the respective coil 3 to generate a magnetic flux in a sense reverse to that of the magnetic flux of the permanent magnet 1, the elastic member 6 is released, and the printing wire 8 is extended through the top portion of by the strain energy stored in the elastic member 6. Thus, the printing operation of the printing head can be carried out.

In the printing head of the above construction in which the printing is effected by releasing respective armature from the permanent magnet, the permanent magnet 1 is arranged outside the iron cores 4 as seen in FIG. 1, and a ferrite type material of low energy product, typically 3–5 mega gauss-oersteds, is principally used for the permanent magnet 1. In order to obtain the energy required for the printing, therefore, the permanent magnet 1 needs a considerable sectional area and height, and its volume occupies a large proportion of the volume of the printing head. The miniaturization of the printing head is accordingly limited.

SUMMARY OF THE INVENTION

The present invention has been made in view of the above drawback, and has for its object to provide a printing head which is smaller in size than the known printing head described above.

According to the present invention, a single small-sized permanent magnet of high energy product is assembled in a magnetic path of magnetic circuits.

PREFERRED EMBODIMENT OF THE INVENTION

Figure 1:
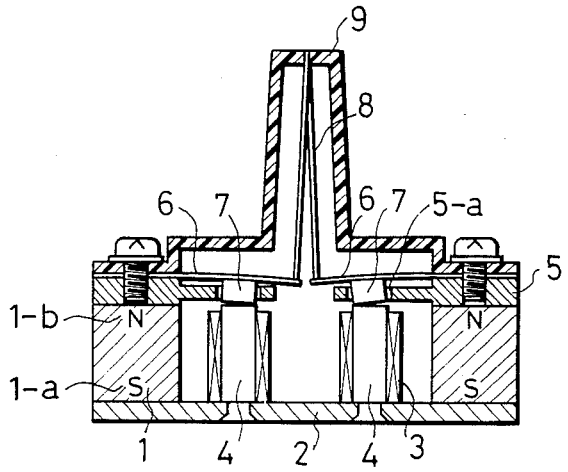
Fig. 1 PRIOR ART
FIG. 1 is a sectional view showing a known impact dot printing head of the type in which the printing is executed by releasing the force of a permanent magnet.
Figure 2:
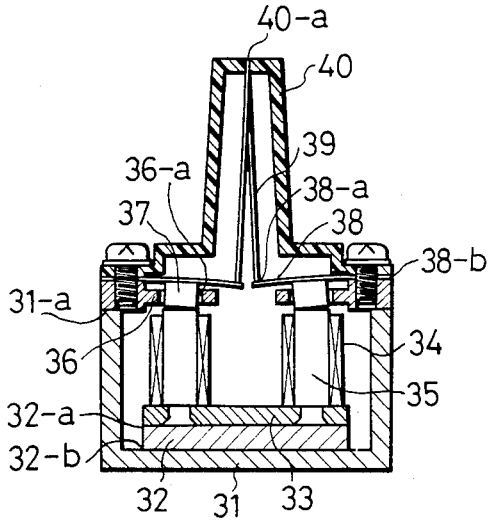
FIG. 2 is a sectional view showing an impact dot printing head according to the present invention.
Figure 3:
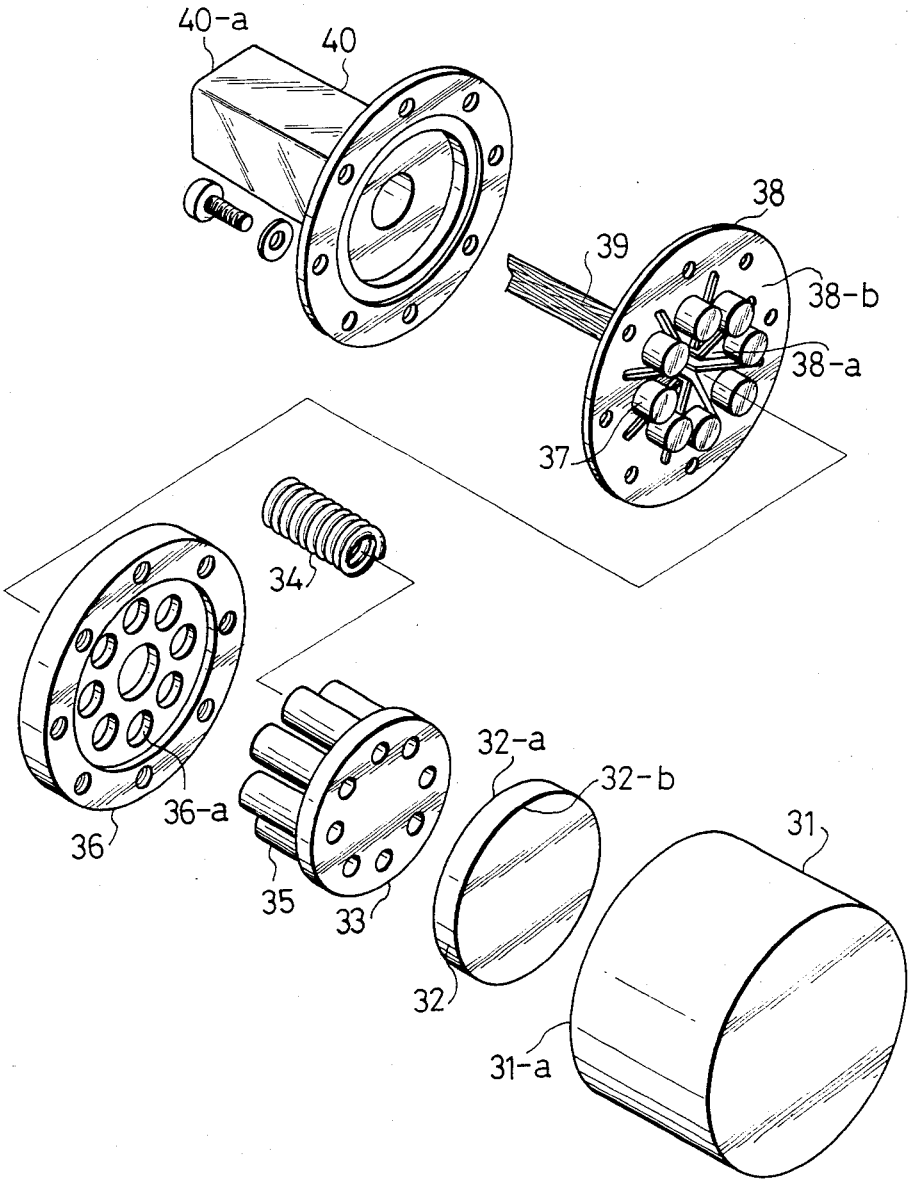
FIG. 3 is an exploded perspective view of the printing head in FIG. 2.

Referring to FIGS. 2 and 3, a cup-shaped outer yoke 31 made of a magnetic material has a flat disc-shaped permanent magnet 32 of high energy product mounted in close contact with the inner bottom surface thereof. A disc-shaped inner yoke 33 is fastened on one pole side 32-*a* of the permanent magnet 32. A plurality of iron cores 35 . . . on which respective coils 34 . . . are wound are fastened to the inner yoke 33 in a circular or nearly circular arrangement in plan by a method such as caulking.

A substantially disc-shaped upper yoke 36 is fastened to the upper end part 31-*a* of the cup-shaped outer yoke 31 by a method such as bonding and welding. The upper yoke 36 has openings 36-*a* . . . which are circular holes, slots or the like, and in which respective armatures 37 . . . are fitted with slight clearances therebetween. The armatures 37 are each made unitary by welding or the like to the intermediate part of a corresponding spring or elastic member 38-*a*. The leaf spring 38-*a* are substantially triangular and are formed by cutting radial grooves from the center of a single spring material 38. A printing wire 39 is fixed to the fore end part of each elastic member 38-*a* (although the wire is fastened in the embodiment, a dotting projection is sometimes fastened to the fore end part). The fore end parts of the printing wires 39 are located at the end part 40-*a* of a case 40 and packed together densely at pitches corresponding to the size of a character or the like and are easily slidable. The base end parts 38-*b* of the elastic members 38-*a* form a unitary structure, and are fastened between the upper yoke 36 and the case 40 by screws or the like.

In the state in which the coils 34 are not energized, the armatures 37 are attracted to the iron cores 35 by the magnetic flux of the permanent magnet since they form part of the magnetic circuit of the permanent magnet. By energizing a selected one of the coils 34 so as to generate a magnetic flux reverse to that of the magnetic flux of the permanent magnet 32, the corresponding elastic member 38-*a* is released, and the corresponding printing wire 39 is protruded by strain energy stored in the elastic member 38-*a*. Thus, the printing operation is effected. The permanent magnet 32 of high energy product signifies, for example, a rare-earth cobalt magnet of high energy product 16–22 mega gauss oersteds. The geometries of the permanent magnet 32 for obtaining the energy required for printing can be made smaller and flatter than those of the permanent magnet in the prior art.

As set forth above, according to the present invention, in the printing head of the type in which the printing is effected by releasing the effect of the permanent magnet, the permanent magnet 32 is not arranged in the outer periphery of the printing head as in the prior art, but it is arranged directly under the inner yoke 33. Therefore, it becomes possible to fabricate a printing head of small outside diameter. In addition, when the permanent magnet 32 of high energy product is used, this magnet may be made flat, and the printing head is miniaturized more. Accordingly, a printing head which is light in weight and small in size can be provided. As a result, the weight of a carriage system on which the head is carried becomes light, a carriage driving motor etc. can be miniaturized, and an equipment itself on which the head is installed becomes small in size and light in weight. In this manner, the practical value of the present invention is great.

What is claimed is:

1. An impact dot printing head comprising a permanent magnet formed into a generally disc shape from a material having a high energy product and arranged as a part of a common magnetic path of a plurality of magnetic circuits; a plurality of magnetic cores having coils wound thereon; an inner yoke contacting said cores, one pole side of said permanent magnet being coupled to a lower part of said inner yoke; an outer yoke substantially cup-shaped, the other pole side of said permanent magnet being coupled to an inner bottom surface of said outer yoke; an upper yoke coupled to an edge of the wall of said outer yoke and provided with openings in its positions aligned with said cores, elastic members fixed at their ends; armatures fastened to said elastic members and rockably fitted in said openings of said upper yoke; and printing projections fixed to fore end parts of said elastic members; said armatures being attracted to said cores against said elastic members by magnetic fluxes of said permanent magnet through said inner yoke, said cores, said outer yoke and said upper yoke; whereby during a printing operation a respective coil can be energized to cancel some of the magnetic flux of said permanent magnet and release the corresponding elastic member thereby to protrude the corresponding printing projection outwardly from the printing head.

2. An impact dot printing head according to claim 1, said energy product being about 16 to about 22 mega gauss-oersteds.

3. In an impact dot printing head including a plurality of printing elements each attached to a respective spring element carrying a respective magnetic armature; holding means establishing a plurality of magnetic circuits each including a respective armature and serving to hold the respective printing element in a retracted position; and means including a respective coil associated with each said armature for selectively cancelling magnetic flux to each said armature to free the associated printing element from its retracted position; the improvement comprising said holding means including a single permanent magnet formed of a material having a high energy product, said permanent magnet being common to each of said magnetic circuits and underlying said armatures, said holding means including an outer yoke element formed generally in the shape of a cup and receiving said permanent manget in the bottom thereof for providing a path for magnetic flux from the magnetic pole formed by the lower face of said permanent magnet through the side wall of said outer yoke to the rim portion thereof; an inner yoke placed over said permanent magnet; a plurality of magnetic core members each extending between said inner yoke and a respective armature for providing a path for magnetic flux from the upper face of said permanent magnet towards each said armature; and an upper yoke extending across the open end of said outer yoke and having a plurality of openings therein each receiving a respective armature for completing the path for magnetic flux.

4. An impact dot printing head according to claim 3, said energy product being about 16 to about 22 mega gauss-oersteds.

* * * * *